US009359101B2

(12) United States Patent
Robertson

(10) Patent No.: US 9,359,101 B2
(45) Date of Patent: Jun. 7, 2016

(54) LEAK RESISTANT FOOD SLEEVE

(71) Applicant: Huhtamaki, Inc., De Soto, KS (US)

(72) Inventor: Ronald D. Robertson, Kansas City, MO (US)

(73) Assignee: Huhtamaki, Inc., De Soto, KS (US)

( * ) Notice: Subject to any disclaimer, the term of this patent is extended or adjusted under 35 U.S.C. 154(b) by 0 days.

(21) Appl. No.: 14/548,507

(22) Filed: Nov. 20, 2014

(65) Prior Publication Data

US 2015/0144687 A1 May 28, 2015

Related U.S. Application Data

(60) Provisional application No. 61/907,683, filed on Nov. 22, 2013.

(51) Int. Cl.

| | |
|---|---|
| ***B65D 75/00*** | (2006.01) |
| ***B65D 5/06*** | (2006.01) |
| ***B65D 5/66*** | (2006.01) |
| ***B65D 5/02*** | (2006.01) |
| ***A47G 21/00*** | (2006.01) |
| ***B65D 5/40*** | (2006.01) |

(52) U.S. Cl.

CPC ..... *B65D 5/0209* (2013.01); *A47G 21/001* (2013.01); *B65D 5/06* (2013.01); *B65D 5/40* (2013.01)

(58) Field of Classification Search

USPC ..... 229/5.8, 405, 137, 213, 128, 107

See application file for complete search history.

(56) References Cited

U.S. PATENT DOCUMENTS

| | | | | |
|---|---|---|---|---|
| 4,267,955 | A | 5/1981 | Struble | |
| 4,470,540 | A | 9/1984 | Koltz | |
| 4,711,389 | A | 12/1987 | Alba et al. | |
| 5,474,232 | A * | 12/1995 | Ljungstrom et al. | 229/137 |
| 6,050,482 | A | 4/2000 | Cai | |
| 6,053,403 | A | 4/2000 | Cai | |
| D469,691 | S * | 2/2003 | Brondyke et al. | D9/431 |
| 6,561,414 | B1 | 5/2003 | Cai | |
| 6,634,547 | B2 | 10/2003 | Willis | |
| 7,523,853 | B2 * | 4/2009 | Kortsmit et al. | 229/108 |
| 2005/0045708 | A1 | 3/2005 | Bodary et al. | |
| 2009/0261156 | A1 * | 10/2009 | Abbott | 229/404 |
| 2013/0200137 | A1 | 8/2013 | Smith | |

* cited by examiner

*Primary Examiner* — Christopher Demeree

(74) *Attorney, Agent, or Firm* — Husch Blackwell LLP

(57) ABSTRACT

A leak resistant food sleeve for holding single-serving food items is provided. The sleeve may be constructed from a blank that is folded into the sleeve when ready to use. The sleeve consists of two major and two minor sidewall panels, and first and second ends. The major and minor sidewall panels are folded to form a box-like structure. The first end consists of two major end flaps, two minor end flaps, and gusset panels extending between and foldably connected to one of the major end flaps and one of the minor end flaps. The gusset panels become layered between the minor end flaps and major end flaps when each is folded inward to close the first end, such that the minor end flaps, gusset panels, and major end flaps form a web of material that prevents fluidal and viscous substances from leaking out of the first end.

8 Claims, 9 Drawing Sheets

LEAK RESISTANT FOOD SLEEVE

CROSS-REFERENCE TO RELATED APPLICATIONS

This Application claims priority to U.S. Provisional Patent Application Ser. No. 61/907,683, filed on Nov. 22, 2013, to Ronald D. Robertson, entitled "Leak Resistant Food Sleeve," the entire disclosure of which is incorporated herein by reference.

BACKGROUND

Single-serving food items sold by fast-food restaurants, takeout restaurants, street-side vendors, and the like generally are designed by be eaten by customers on the go and by hand without the use of plates, bowls, or utensils. These single-serving food items include burritos, salad wraps, sandwich wraps, hotdogs, bratwursts, pizza, pizza rolls, egg rolls, pastries and the like. These food items generally have an elongated shape to make them easier to hold. Additionally, these food items generally include sauces, dressings, condiments, greases, and other fluids that may drip-off while the item is being eaten or carried. Many of these food items are sold in a foil wrapper or container or box. However, these wrappers and containers fail to prevent sauces, dressings, condiments and the like from leaking out onto the customer, clothing, the floor, etc. when the food item is being eaten or carried.

These wrappers and containers are designed to be able to be folded in a flat configuration prior to use such that they may be efficiently transported and stored. However, allowing such a configuration makes it more difficult to make the container or wrapper leak resistant when assembled. Additionally, the contents of these containers or wrappers must be easily accessible so that customers can gain access to the items therein. This also increases the difficulty of creating a leak resistant container.

Accordingly, a need exists for a container or sleeve that is leak resistant such that when food items containing sauces, dressings etc. are placed inside, the sauce, dressing etc. will not leak onto the customer or elsewhere. A need also exists for this container or sleeve to be of a design that may be folded in a substantially flat configuration when not it use and be easily opened by customers.

SUMMARY OF THE INVENTION

An objective of the present invention is to provide a food carton or sleeve that is leak resistant for holding single-serving food items commonly eaten without plates, bowls, or utensils. A further objective of the present invention is to provide such a food carton or sleeve that can be formed from a unitary blank and folded flat until ready for use.

In one embodiment of the present invention, a leak resistant food sleeve is constructed from a unitary blank cut from a larger sheet of material. The sleeve may include two major sidewall panels, two minor sidewall panels, an overlapping panel, a first end, and optionally a second end. The sidewall panels may be connected by fold lines extending in the longitudinal direction such that each major sidewall panel is adjacent to a minor sidewall panel when the sleeve is formed. The overlapping panel may be connected to one of the major sidewall panels by a fold line extending in the longitudinal direction. To form the sleeve, the blank can be folded along the longitudinal fold lines and the overlapping panel can be adhesively bonded to and overlapping one of the minor sidewall panels, thereby forming a box-like structure.

The first end of the sleeve is designed to be leak resistant in order to prevent liquids and other viscous substances from the various food items inserted into the sleeve from leaking out while handled or consumed. The first end may include two major end flaps, two minor end flaps, and gusset panels connecting the end flaps. The major end flaps may be connected to a corresponding major sidewall panel by an arcuate fold line that extends at least partially into the major sidewall panel to form a concave orientation in the blank. The concave orientation assists in creating and maintaining a slight outward bow of the major sidewall panels when the sleeve is formed. The minor end flaps may each be connected to a corresponding minor sidewall panel by generally horizontal fold lines. Gusset panels may extend between and are foldably connected to each adjacent major and minor end flap. In one embodiment, the fold line connecting each gusset panel to a major end flap is oriented diagonally into the major sidewall panel.

When the minor end flaps are folded inward toward the center of the first end, the gusset panels may rotate down and inward toward the major end flaps such that they become substantially parallel to the interior surface of the major end flaps. This orientation helps snap and hold minor end flaps into a folded position. When the major end flaps are folded inward toward the center of the first end, the gusset panels can become layered between the minor end flaps and the major end flaps so as to create a web of material. The web of material creates traps at each of the corners of the first end. These traps are capable of holding a certain amount of fluidal or viscous substance that may be emitted from a food item located in the sleeve.

In one embodiment, the major end flaps include tongues that each have a distal edge. The distal edge may be configured to conform to the concave orientation of the fold line between the opposing major sidewall panel and opposing major end flap. The tongue and conforming distal edge can assist in keeping the first end in a closed configuration.

The second end may optionally be constructed in the same manner and with the same components as the first end. Alternatively, the second end may be left open such that each of the major and minor sidewall panels have terminal ends where access to the contents of the sleeve is left unobstructed.

Other aspects and advantages of the present invention will be apparent from the following detailed description of the preferred embodiments and the accompanying drawing figures.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

DETAILED DESCRIPTION OF THE INVENTION

Figure 1:
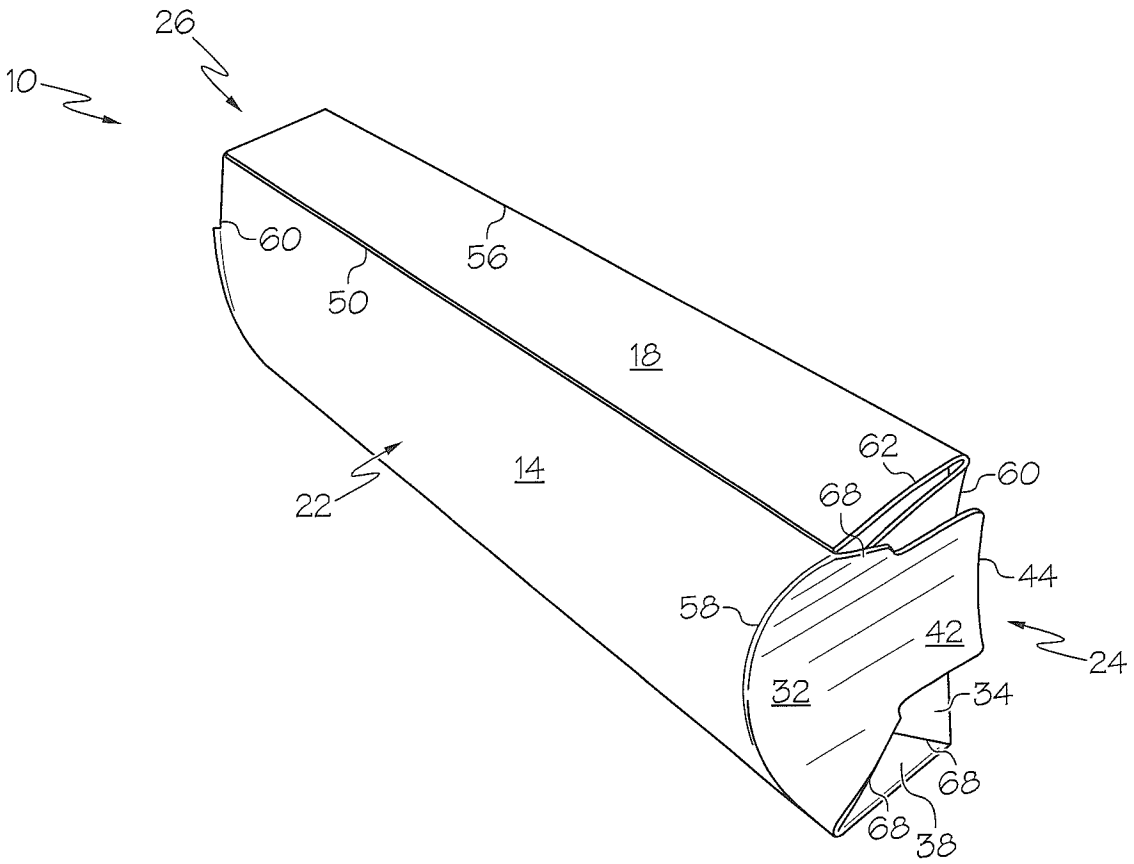
FIG. 1 is an end perspective view of a leak resistant sleeve with a closed first end in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
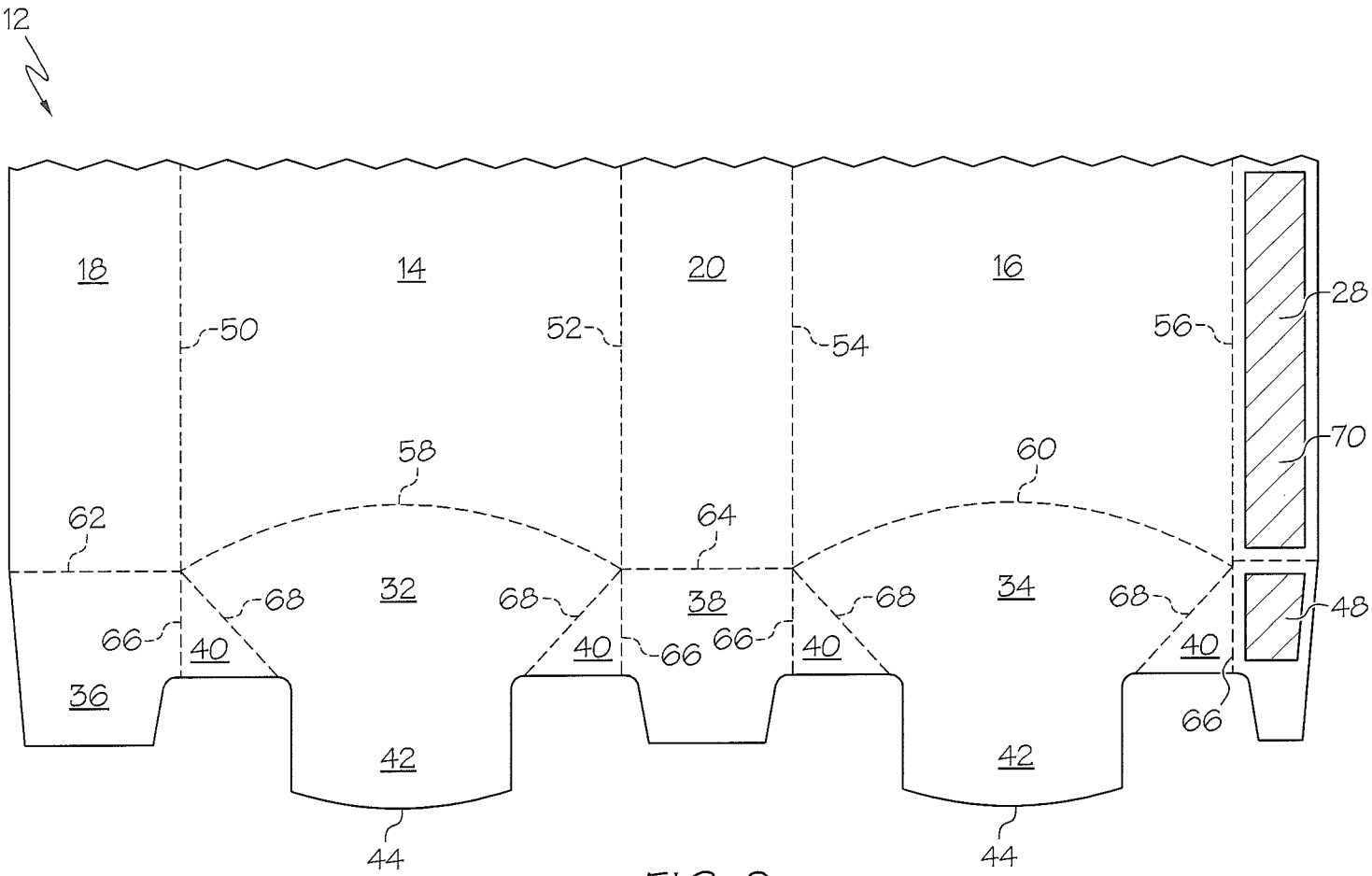
FIG. 2 is a plan view of a partial blank from which a leak resistant food sleeve may be formed in accordance with one embodiment of the present invention.

The present invention is directed generally to a leak resistant food carton or sleeve 10, as shown in FIG. 1, which may be generally adapted for holding packaged single-serving food items. The sleeve 10 can be constructed of any suitable flexible or semi-rigid material, such as a paperboard material. The paperboard or other suitable material may have a coating and/or graphics applied thereto. As shown in FIG. 2, sleeve 10 to may be formed from a blank 12, which may be cut from a larger sheet or roll of material. Sleeve 10 may be comprised of two major panels 14 and 16, two minor panels 18 and 20, an overlapping panel 28, a first sleeve end 24 and a second sleeve end 26. An elongate sidewall 22 extending between first sleeve end 24 and second sleeve end 26 may be formed by the folding of major and minor panels 14, 16, 18, and 20.

As shown in FIG. 2, the major and minor panels 14, 16, 18, and 20 may be hingedly connected to each other by sidewall longitudinally-extending fold lines 50, 52, and 54. In the embodiment shown in the figures, major panel 14 is connected to minor panels 18 and 20 at major panel's 14 opposing longitudinal ends by sidewall fold lines 50 and 52 respectively, major panel 16 is connected to minor panel's 20 opposing longitudinal end by sidewall fold line 54, and overlapping panel 28 is connected to the longitudinal end of major panel 16 opposite of sidewall fold line 54 by sidewall fold line 56. Alternatively, overlapping panel 28 may be connected to the longitudinal end of minor panel 18 opposite of sidewall fold line 50. When panels 14, 16, 18, and 20 are folded along sidewall fold lines 50, 52, and 54, and overlapping panel 28 is folded along sidewall fold line 56, overlapping panel 28 may be attached to minor panel 18 in order to form sleeve 10. Overlapping panel 28 may be attached to either the interior or exterior surface of minor panel 18 such that overlapping panel 28 and minor panel 18 overlap forming an overlapping side-seam 30. Alternatively, if overlapping panel 28 is foldably connected to minor panel 18 at sidewall fold line 56, then overlapping panel 28 is attached to major panel 16 in order to form sleeve 10 such that overlapping panel 28 and major panel 16 at least partially overlap to form overlapping side-seam 30. The attachment of overlapping panel 28 may be accomplished through an adhesive bond, adhesive strip 70 or any other suitable method that fixedly secures overlapping panel 28 to the corresponding minor or major panel. Overlapping panel 28 may also include an overlapping panel end flap 48 that is attached to the end flap of the corresponding panel (e.g., minor end flap 36), forming part of overlapping side-seam 30 when the sleeve 10 is configured. In an alternative embodiment, overlapping panel 28 does not contain an overlapping panel end flap 48. As shown in the figures, when major and minor panels 14, 16, 18, and 20 are folded at sidewall fold lines 50, 52, 54, and 56 and connected by overlapping panel 28, sidewall 22 is formed.

Figure 5:
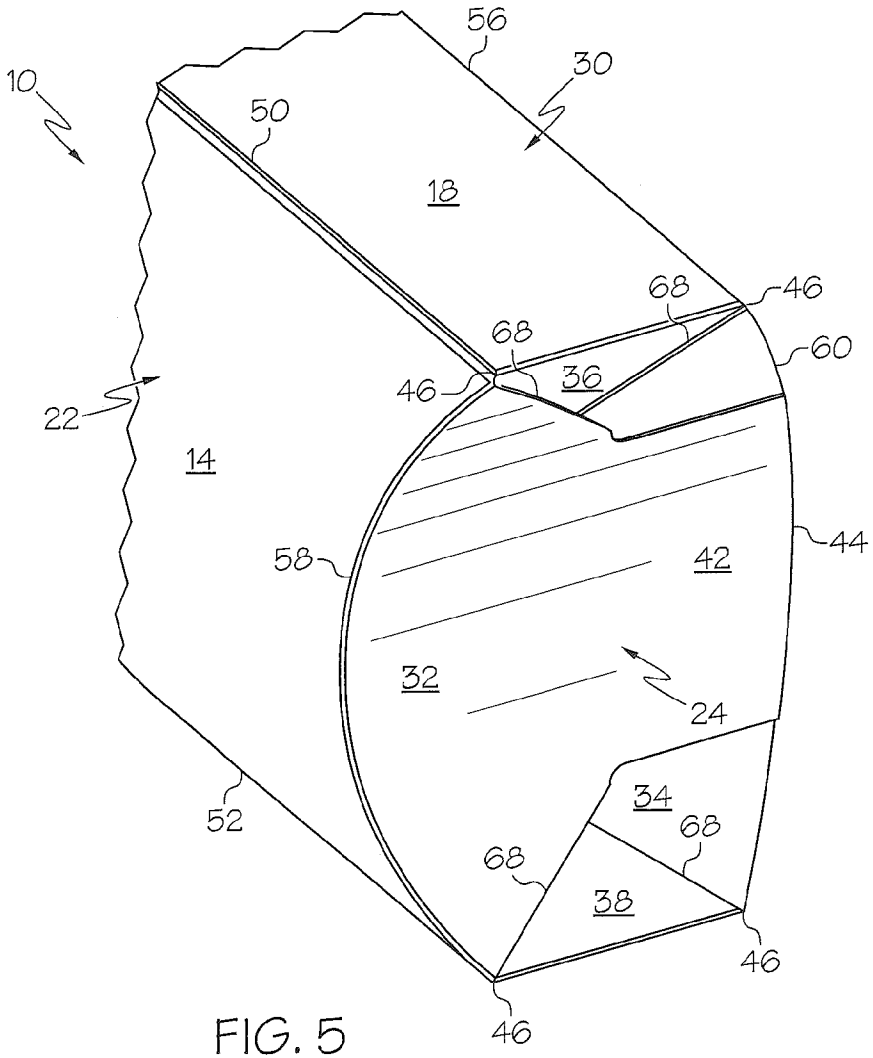
FIG. 5 is a partial end perspective view of the leak resistant food sleeve of FIG. 1 having its major and minor end flaps in closed positions in accordance with one embodiment of the present invention.
Figure 6:
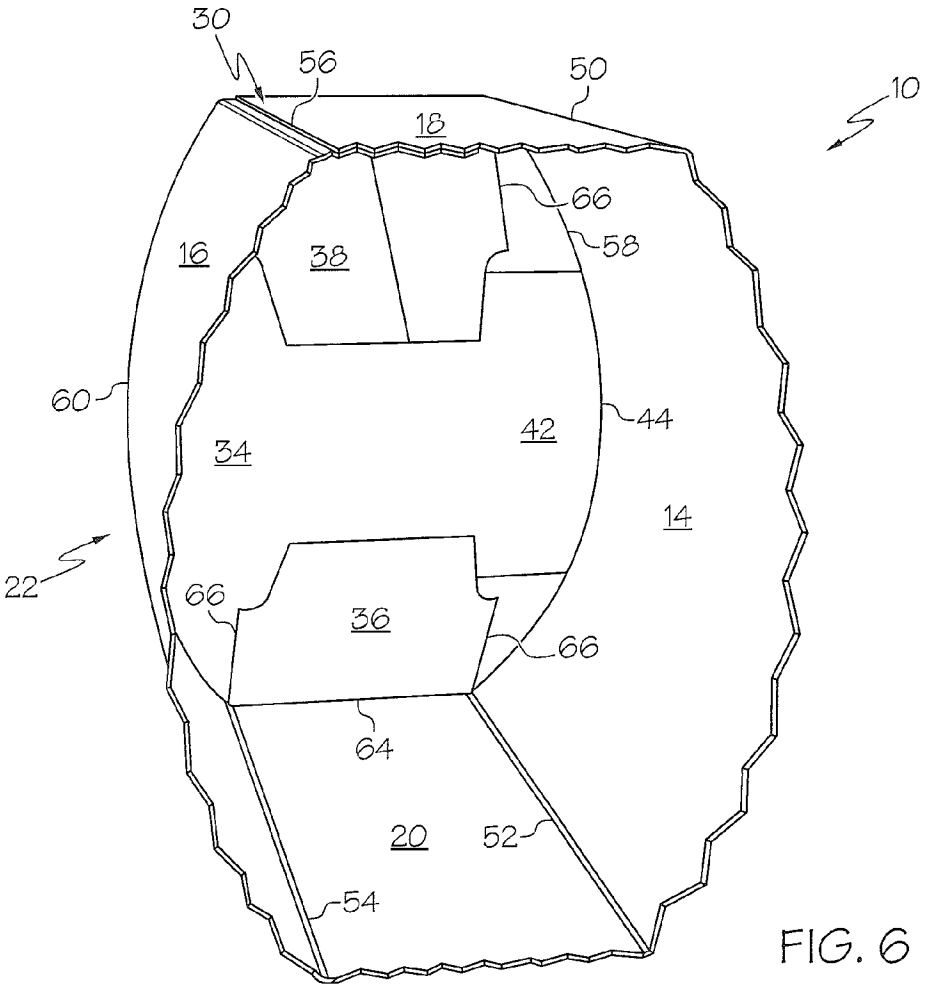
FIG. 6 is a partial perspective view of the interior of the leak resistant food sleeve of FIG. 1 having its major and minor end flaps in closed positions in accordance with one embodiment of the present invention.

As best shown in FIGS. 5 and 6, in one embodiment of the invention, major panels 14 and 16 may bow outwardly, while minor panels 18 and 20 are generally flat when sleeve 10 is formed. However, it is understood that major panels 14 and 16 may also remain in a generally straight or flat configuration such that sidewall 22 maintains a generally rectangular box-like shape.

One or both of first sleeve end 24 and second sleeve end 26 of sleeve 10 are constructed to be leak resistant. The figures show a sleeve 10 with only first sleeve end 24 as having a leak-resistant construction, but it is understood that the opposing second sleeve end 26 may have a leak-resistant construction as well. While the following description explains a leak-resistant end construction with reference only to first sleeve end 24, it should be understood that second sleeve end 26 may be constructed with the same components and in the same manner as first sleeve end 24.

First sleeve end 24 may be comprised of two major end flaps 32 and 34, two minor end flaps 36 and 38, and four gusset panels 40 extending between adjacent major and minor end flaps 32, 34, 36, and 38. Major end flaps 32 and 34 may each contain a longitudinally extending tongue 42 with a distal edge 44 as shown in FIG. 2. The figures illustrate major end flaps 32 and 34 as being larger than minor end flaps 36 and 38. However, in one embodiment, major end flaps 32 and 34 may be of similar size to minor end flaps 36 and 38. Major end flaps 32 and 34 are hingedly connected to major panels 14 and 16, respectively, by major end fold lines 58 and 60, respectively, as shown in FIG. 2. Similarly, minor end flaps 36 and 38 are hingedly connected to minor panels 18 and 20, respectively, by minor end fold lines 62 and 64, respectively, as shown in FIG. 2.

Figure 7B:
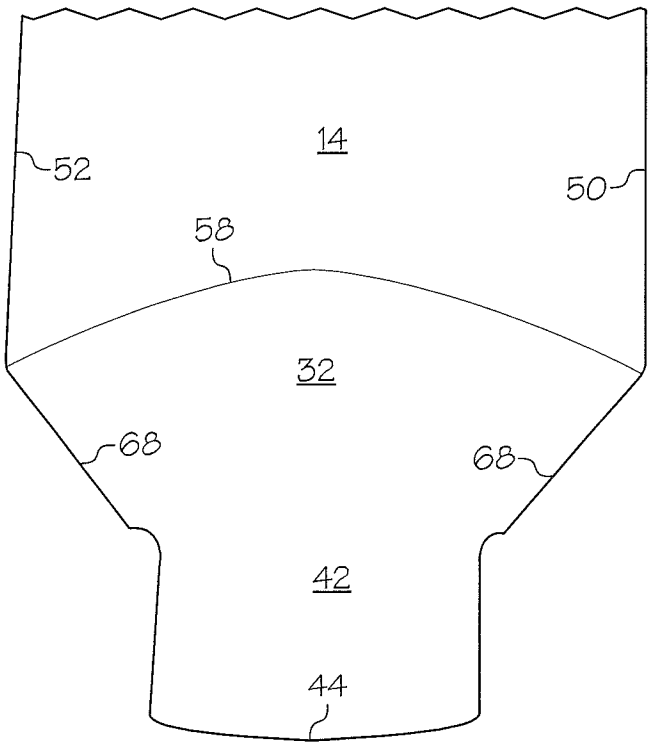
FIG. 7B is a partial plan view of the leak resistant food sleeve of FIG. 4.
Figure 7A:
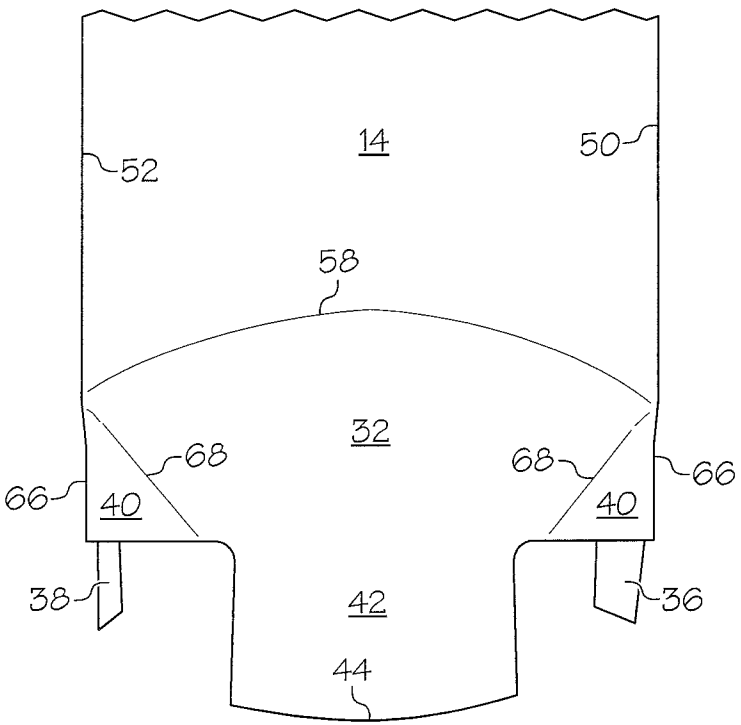
FIG. 7A is a partial plan view of the leak resistance food sleeve of FIG. 3.
Figure 7C:
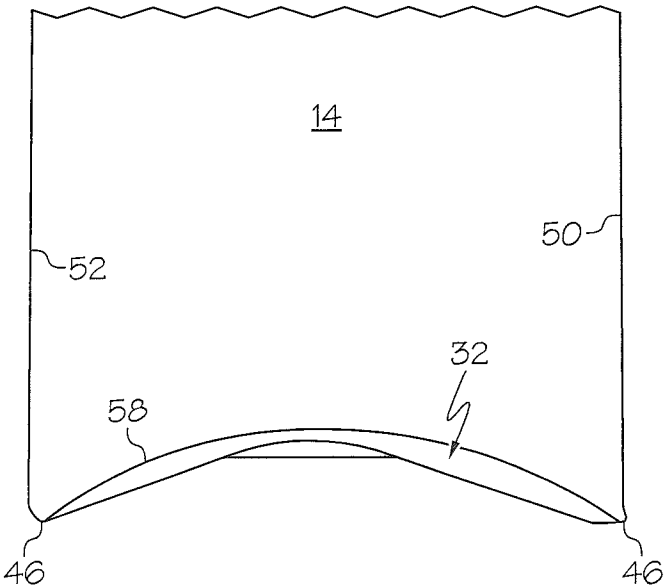
FIG. 7C is a partial plan view of the leak resistant food sleeve of FIG. 5.
Figure 8:
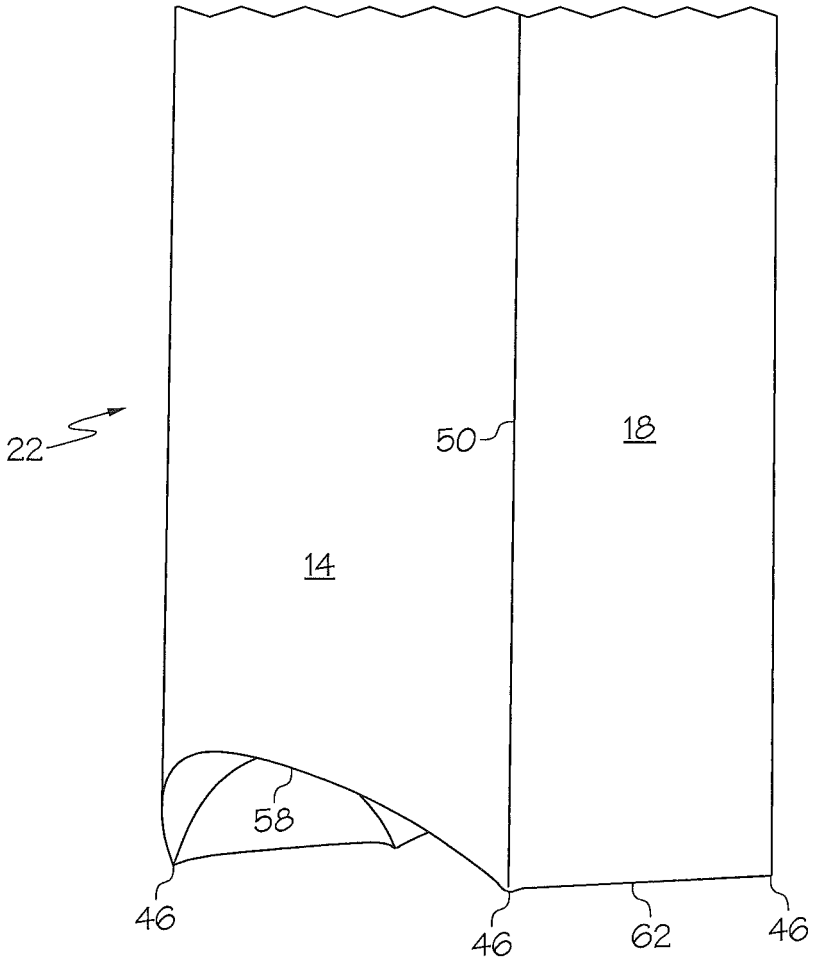
FIG. 8 is a partial side perspective view of the leak resistant container of FIG. 1 showing the first end in a completely closed position and standing vertically on end points at each of the corners of the first end.

In one embodiment, major end fold lines 58 and 60 are generally curved or arcuate and have a concave arrangement with respect to major panels 14 and 16, while minor end fold lines 62 and 64 remain generally straight, as best shown in FIGS. 7A-C. In this embodiment, the arcuate major end fold lines 58 and 60 extend slightly longitudinally inward with respect to major panels 14 and 16, as depicted in FIG. 2. This concave arrangement results in the major panels 15 and 16 having an outwardly bowed shape when sleeve 10 is formed and one or both of ends 24 and 26 are in a closed configuration. As shown in FIG. 8, the concave arrangement also creates end points 46 at the ends of fold lines 50, 52, 54, and 56 when the major and minor end flaps 32, 34, 36, and 38 are inwardly folded to close first sleeve end 24. The end points 46 allow sleeve 10 to be placed on it first sleeve end 24 and remain in an upright position. Second sleeve end 26 may, but is not required, to have concave major end fold lines 58 and 60. In an alternative embodiment, major end fold lines 58 and 60 have a generally straight arrangement, similar to the minor end fold lines 62 and 64.

Figure 3:
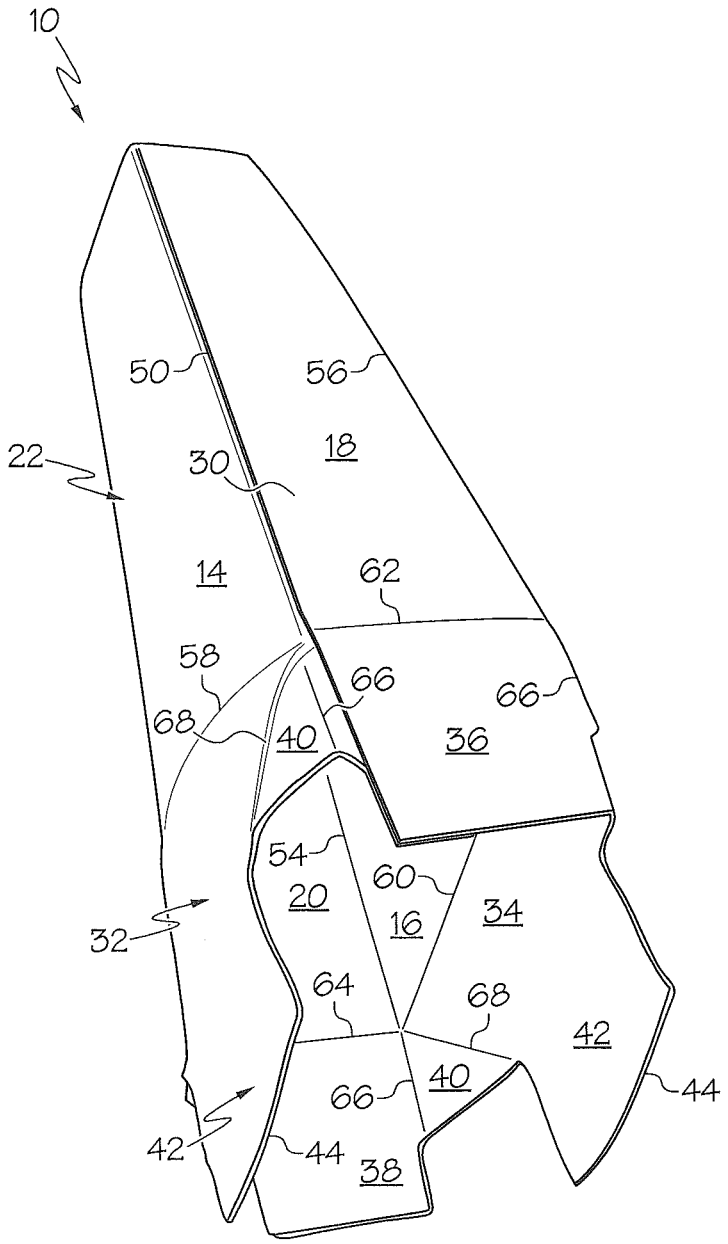
FIG. 3 is an end perspective view of the leak resistant food sleeve of FIG. 1 having its major and minor end flaps in open positions in accordance with one embodiment of the present invention.

First sleeve end 24 also includes one or more gusset panels 40 that extend between, and are hingedly connected to, the major and minor end flaps 32, 34, 36, and 38. As shown in FIGS. 2 and 3, gusset panels 40 are located between minor end flap 36 and major end flap 32, major end flap 32 and minor end flap 38, minor end flap 38 and major end flap 34, and major end flap 34 and overlapping panel end flap 48. Each gusset panel 40 is hingedly connected to its corresponding minor and major end flaps by first and second gusset panel fold lines 66 and 68, respectively. In order to facilitate the folding of the gussets 40, first and second gusset panel fold lines 66 and 68 can be formed at various angles. As shown in FIGS. 2 and 3, in one embodiment, second gusset panel fold line 68 extends diagonally inwardly approximately 45-degrees (although other angles are within the scope of the invention) from the end of major end fold line 58 or 60 with respect to gusset panel fold line 66 so as to give gusset panel 40 a triangular shape. The particular angle of second gusset panel fold line 68 may vary depending on the dimensions of the other elements of sleeve 10. In another embodiment, first gusset panel fold lines 66 are angled inwardly with respect to minor end flaps 36 and 38 and second gusset panel fold lines 68 are substantially in line with the longitudinal axis of sleeve 10. In yet another embodiment, both first and second gusset panel fold lines 66 and 68 have an angled orientation.

Figure 4:
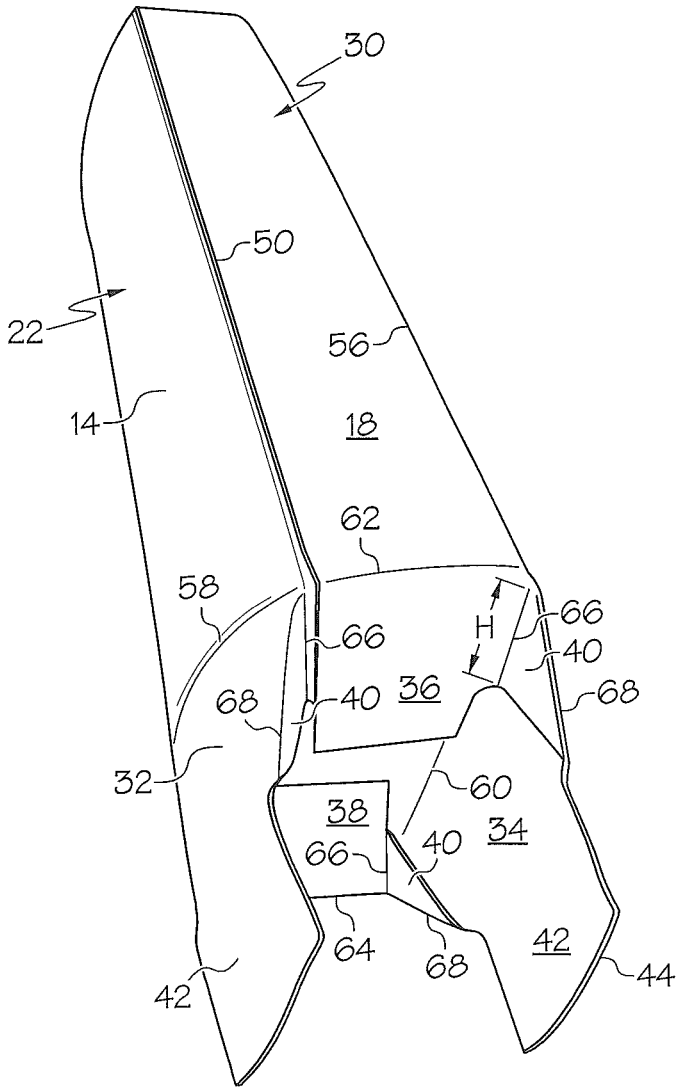
FIG. 4 is an end perspective view of the leak resistant food sleeve of FIG. 1 having its major end flaps in open positions and minor end flaps in closed positions in accordance with one embodiment of the present invention.

The gusset panels 40 created by first and second gusset panel fold lines 66 and 68 form a web of material when the major and minor end flaps 32, 34, 36, and 38 are folded inwardly. Minor end flaps 36 and 38 are folded inward along minor end fold lines 62 and 64, respectively, as shown in FIG. 4. As a result, gusset panels 40 become substantially in-line with major end flaps 32 and 34 and become generally perpendicular to minor end flaps 36 and 38. Major end flaps 32 and 34 are then folded inwardly along major end fold lines 58 and 60, respectively. This creates a layered arrangement between the end flaps and gusset panels. The gusset panels 40 become situated between minor end flaps 36 and 38 and major end flaps 32 and 34, creating the web of material. This web of material is capable of holding a fixed amount of fluidal or viscous substances within the sleeve 10 and preventing the leakage thereof.

FIGS. 3 and 7A illustrates the sleeve 10 with all of the major and minor end flaps 32, 34, 36, and 38 in open positions. FIGS. 4 and 7B demonstrate the sleeve with the major end flaps 32 and 34 in an open position and the minor end flaps 36 and 38 folded about fold lines 62 and 64, respectively, and deflected inwardly to a closed position. As depicted in FIG. 4, the gusset panels 40 extend between the major end flaps 32 and 34 and minor end flaps 36 and 38 forming a web therebetween, thus, eliminating a potential avenue through which the packaged product could otherwise escape. As opposed to cutting or slitting the material between the adjacent end flaps 32 and 36, 32 and 38, 38 and 34, and 34 and 36, that material is folded up in a series of inward folds to form a mechanical seal. When being folded inwardly, the minor end flaps 36 and 38 may snap into place and be retained in a closed position due to the gusset panels 40.

FIGS. 5 and 7C illustrate the sleeve 10 with both major and minor end flaps 32, 34, 36, and 38 deflected inwardly to closed positions. The major end flaps 32 and 34 are folded about fold lines 58 and 60, respectively, and are in an overlapping orientation with respect to the minor end flaps 36 and 38. Tongues 42 of major end panels 32 and 34 extend across first sleeve end 24 such that distal edge 44 may terminate at opposing major panel 14 or 16. Distal edge 44 may have a radius profile that corresponds generally with that of the opposing panel 14 or 16. When folded, the distal edge 44 of one major end flap 32 or 34 may engage the major end fold line 58 or 60 of the opposing major end flap 32 or 34 to keep the major and minor end flaps 32, 34, 36, and 38 in a closed orientation. It is understood that one or both of the minor end flaps 36 and 38 may also include a tongue that is shaped and sized to engage the fold line 62 or 64 of the opposing minor end flap 36 or 48 so as to keep the minor end flaps 36 and 38 in a closed orientation.

When all of the major and minor end flaps 32, 34, 36, and 38 are folded into their closed positions, the gusset panels 40 are positioned in a generally flat orientation between the major end flaps 32 and 34 and the minor end flaps 36 and 38. Due to the concave arrangement of the major end fold lines 58 and 60, first sleeve end 24 also contains a concave arrangement as best shown in FIG. 7C. Because gusset panels 40 are generally flat with respect to major and minor end flaps 32, 34, 36, and 38, a webbed corner closure is created such that gusset panels 40 trap fluidal and viscous substances in the corners of first sleeve end 24. These substances will be trapped and contained within sleeve 10 (when it is lying flat on minor panel 18, for example) so long as the level of the substances does not rise above the height H of the gusset panels 40.

Second sleeve end 26 may be constructed similar to first sleeve end 24 in order to create a sleeve 10 that is leak-resistant on both ends in order to prevent leakage of packaged food items prior to being consumed. Alternatively, second sleeve end 26 may be constructed using major and minor flaps without gusset panels or even without some or all of major or minor flaps so as to leave access to the inside of sleeve 10 completely unobstructed from second sleeve end 26.

As mentioned above, the sleeve 10 may be constructed from a blank 12 of material, which may be die cut from a larger sheet or roll of material. The blank 12 is folded longitudinally along fold lines 50, 52, 54, and 56 to form the elongate sidewall 22. The overlapping panel 28 is adhesively bonded to the minor panel 18 to form an overlapping side-seam 30. Sleeve 10 may then be folded into a flat configuration along fold lines 50 and 54, or along fold lines 52 and 56, until ready for use. First sleeve end 24, and optionally second sleeve end 26, is then folded as set forth above to form a leak resistant sleeve 10.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A leak resistant container comprising:

first and second major sidewall panels, each of said major sidewall panels having a slightly outward bowed shape when said container is in a closed position;

first and second minor sidewall panels;

first and second major end flaps, each of said major end flaps including a narrowed tongue with a distal edge substantially conforming to said slightly outward bowed shape of said major sidewall panels;

first and second minor end flaps; and gusset panels, wherein each said gusset panel extends between and is foldably connected to one of said major end flaps and one of said minor end flaps;

wherein said first major sidewall panel is foldably connected to said first major end flap by an arcuate fold line extending longitudinally inward with respect to said first major sidewall panel;

wherein a first one of said gusset panels is connected to a lateral side of said first major end flap by a first diagonally-orientated fold line and a second one of said gusset panels is connected to an opposing lateral side of said first major end flap by a second diagonally-orientated fold line; and wherein said first and said second diagonally-orientated fold lines extend inward relative to said first major end flap forming said narrowed tongue on said first major end flap that extends beyond said diagonally-orientated fold lines connecting said first and said second one of said gusset panels.

2. The leak resistant container of claim 1, wherein at least one of said first and second major sidewall panels bows outwardly.

3. The leak resistant container of claim 1, wherein said gusset panels are situated between said minor end flaps and major end flaps when both said major and minor end flaps are folded inwardly so as to create a web of material at each corner of said end configuration.

4. A foldable blank used for forming a leak resistant container, said blank comprising:

a plurality of sidewall panels connected by fold lines; and an end configuration comprising:

two opposing major end flaps, each of said major end flaps being foldably connected to one of said plurality of sidewall panels by an arcuate fold line extending longitudinally inward with respect to said sidewall panel;

two opposing minor end flaps adjacent to said major end flaps; and gusset panels, wherein each of said gusset panels extends between and is foldably connected to one of said major end flaps and one of said minor end flaps;

wherein a length of each of said two opposing major end flaps is greater than a length of each of said gusset panels; and wherein each of said two opposing major end flaps have one of said gusset panels foldably connected on each lateral edge of said major end flap by a diagonal fold line extending inward relative to said major end flap, said diagonal fold lines terminating along said lateral edges of said major end flap before said diagonal fold lines converge.

5. The bank of claim 4 further comprising an overlapping panel connected by a fold line to one of said sidewall panels.

6. The blank of claim 5, wherein said overlapping panel contains an adhesive strip.

7. The blank of claim 4, wherein at least one of said gusset panels is triangular in shape.

8. The blank of claim 4, wherein at least one of said major end flaps contains a tongue with a distal edge that extends beyond said diagonal fold lines connecting said gusset panels to said major end flap.

* * * * *